US005391979A

United States Patent [19]

Kajimoto et al.

[11] Patent Number: 5,391,979

[45] Date of Patent: Feb. 21, 1995

[54] CONSTANT CURRENT GENERATING CIRCUIT FOR SEMICONDUCTOR DEVICES

[75] Inventors: Takeshi Kajimoto; Takayuki Miyamoto, both of Hyogo, Japan

[73] Assignee: Mitsubishi Denki Kabushiki Kaisha, Tokyo, Japan

[21] Appl. No.: 135,512

[22] Filed: Oct. 13, 1993

[30] Foreign Application Priority Data

Oct. 16, 1992 [JP] Japan ..... 4-278575

[51] Int. Cl.[6] ..... G05F 3/16

[52] U.S. Cl. ..... 323/313; 323/315; 327/543

[58] Field of Search ..... 323/312, 313, 314, 311, 323/315; 307/296.1, 296.6

[56] References Cited

U.S. PATENT DOCUMENTS

| | | | |
|---|---|---|---|
| 4,322,676 | 3/1982 | Toyoda | 323/313 X |
| 4,527,213 | 7/1985 | Ariizumi | 361/56 |
| 4,771,227 | 9/1988 | Nelson | 323/312 X |
| 5,278,491 | 1/1994 | Nitta et al. | 323/313 |
| 5,315,230 | 5/1994 | Cordoba et al. | 323/313 |

OTHER PUBLICATIONS

"VLSI Analog Integrated Circuit Design Technology", by P. R. Gray, published by Baifu-kan, pp. 304–308.

*Primary Examiner*—Steven L. Stephan
*Assistant Examiner*—Y. Jessica Han
*Attorney, Agent, or Firm*—Lowe, Price, LeBlanc & Becker

[57] ABSTRACT

The constant current generating circuit includes a high resistance element for generating a very small current. This very small current is supplied to a first MOS transistor having a sufficiently large gate width to gate length ratio. The gate-source voltage of the first MOS transistor becomes its threshold voltage VTH, and the voltage applied across a resistance connected between the gate of the first MOS transistor and the ground line is set to a constant value VTH. Thus, a constant current is normally passed through the resistance. Since the very small current is supplied from the high resistance element which is normally turned on, regardless of the change of the power supply voltage, a constant current can be generated stably.

12 Claims, 9 Drawing Sheets

CONSTANT CURRENT GENERATING CIRCUIT FOR SEMICONDUCTOR DEVICES

BACKGROUND OF THE INVENTION

1. Field of the Invention

The present invention relates to a circuit structure for generating a constant current in a semiconductor device and in a semiconductor circuit, and more particularly, to a circuit structure generating a constant current utilized for generating a reference voltage. Further, the present invention relates to a constant current generating circuit utilized in a internal voltage-down converter which down-converts power supply voltage in a semiconductor memory device such as a DRAM (Dynamic Random Access Memory).

2. Description of the Background Art

In a semiconductor circuit and a semiconductor memory device, a circuit which generates a constant current is used in various portions. Such a constant current generating circuit is used for generating a constant reference voltage, or is employed as a current supply for a differential amplifying circuit, or is utilized as a high resistance transistor load (so called active load).

One of the circuit portions utilizing such a constant current generating circuit is an internal voltage-down converter of a DRAM. The internal voltage-down converter produces an internal power supply voltage by down-converting an externally applied power supply voltage. Such an internal voltage-down converter is utilized because of the following reasons.

Memory capacity of a DRAM has been more and more increased. Increase of the memory capacity of the DRAM can be implemented through high density and high integration of elements thanks to the miniaturization technology. MOS (insulated gate-type field effect) transistors serving as components can be reduced in size by such a miniaturization technology. Also, a thickness of the interlayer insulating film for isolating signal lines or isolating elements can be-reduced.

On the other hand, logic LSI (Large Scale Integration) such as a microprocessor which determines power supply of a system is not made so much small as DRAM, and a relatively high voltage is used as a power supply voltage.

Thus, when the external supply voltage is applied to a component of the semiconductor memory device such as a DRAM, it will be difficult to keep the reliability of a breakdown voltage of MOS transistor, a breakdown voltage of the interlayer insulating film, and the like. Therefore, the internal supply voltage is produced by down-converting the external supply voltage utilizing the internal voltage-down converter, and accordingly the reliability of the components of the semiconductor memory device such as a miniaturized DRAM can be maintained.

FIG. 10 shows an overall structure of a conventional DRAM. In FIG. 10, DRAM 100 includes an internal voltage-down converter 102 which down-converts external power supply voltage Vcc applied on an external supply line 112 via a power supply node 109 and transmits internal power supply voltage Vdd on an internal power supply line 114; an internal circuit 104 which operates using internal power supply voltage Vdd on internal supply line 114 as an operating power supply voltage, and an externally-powered circuit 106 which operates using external power supply voltage Vcc applied on external supply line 112 as an operating power supply voltage.

Also, the other power supply voltage (referred to simply as ground voltage hereinafter) Vss is applied to internal voltage-down converter 102, internal circuit 104 and externally-powered circuit 106 via the other power supply node (referred to as ground node hereinafter) 110 and the other supply line (referred to simply as ground line hereinafter) 116. Internal circuit 104 includes at least an array of memory cells, since the memory cell is most finely processed and a high voltage can not be applied to this portion in view of reliability.

Externally-powered circuit 106 includes a data input/output circuit which carries out input/output of data with the outside of the device for input/output of data at high speed and for providing an interface with an external device. Peripheral circuits such as an address decoder and a control circuit may be included in externally-powered circuit 106 or in internal circuit 104. The size of MOS transistor to which external power supply voltage Vcc is applied should be made relatively large, while MOS transistor which is driven at a relatively high voltage can operate at a high speed. Consideration of both of the above conditions determines which of internal power supply voltage Vdd and external power supply voltage Vcc should drive the peripheral circuits.

Internal voltage-down converter 102 is required to generate a stable internal power supply voltage Vdd in order to guarantee the operational stability of internal circuit 104. Various structures have been proposed for such an internal voltage-down converter.

FIG. 11 shows an example of a structure of a conventional internal voltage-down converter. In FIG. 11, internal voltage-down converter 102 includes a reference voltage generating circuit 124 which generates a predetermined reference voltage VREF; a differential amplifier 122 receiving at its negative input reference voltage VREF from reference voltage generating circuit 124 and receiving at its positive input internal power supply voltage Vdd on internal supply line 114; and a p-channel MOS transistor 120 responsive to an output of differential amplifier 122 for supplying current on internal supply line 114 from external supply line 112.

Reference voltage generating circuit 124 includes a constant current generating circuit 130 which is connected to external supply line 112 to generate a constant current, and a constant voltage diode 132 which generates a predetermined reference voltage VREF using a reference current from constant current generating circuit 130 as an operating current. Constant voltage diode 132 operates by using a constant current from constant current generating circuit 130 as a Zener current, and generates reference voltage VREF based on the Zener voltage. The operation of internal voltage-down converter 102 shown in FIG. 11 will be described below.

Differential amplifier 122 amplifies differential voltage between reference voltage VREF and internal power supply voltage Vdd. When internal power supply voltage Vdd is higher than reference voltage VREF, an output of differential amplifier 122 becomes higher than a predetermined level. Accordingly, conductance of p-channel MOS transistor 120 is made smaller (or potential difference between gate and source becomes smaller), and the amount of the current transmitted from external supply line 112 to internal supply line 114 via p-channel MOS transistor 120 is reduced. Thus, increase of internal power supply voltage Vdd is prevented.

When internal power supply voltage Vdd becomes lower than reference voltage VREF, an output of differential amplifier 122 becomes lower than a predetermined level, so that conductance of p-channel MOS transistor 120 is increased. Accordingly, the amount of current supplied from external supply line 112 to internal supply line 114 is increased, and also internal power supply voltage Vdd is increased.

Internal voltage-down converter 102 provides a function of generating internal power supply voltage Vdd which is approximately at the same level as reference voltage VREF. Internal power supply voltage Vdd is required to be kept sufficiently stable for the stable operation of the internal circuit. Constant current generating circuit 130 is required to generate a constant current stably.

FIG. 12 shows a structure of a conventional constant current generating circuit. The constant current generating circuit shown in FIG. 12 is described, for example, in *VLSI Analog Integrated Circuit Design Technology,* by P. R. Gray et al., translated by Yuzuru Nagata et al., published in Japan by Baifu-Kan, pp 305–307.

In FIG. 12, constant current generating circuit 130 includes a p-channel MOS transistor 154 having its source connected to external supply line 112, its gate connected to node A, and its drain connected to node B, a p-channel MOS transistor 155 having a source connected to external supply line 112, its drain connected to node A, and its gate connected to node A; a n-channel MOS transistor 151 having its drain connected to node B, its gate connected to node C and its source connected to ground line 116; a resistance 152 connected between node C and ground line 116, a n-channel MOS transistor 153 having its drain connected to node A, its gate connected to node B, and its source connected to node C; and a p-channel MOS transistor 156 having its source connected to external supply line 112, its gate connected to node A, and its drain connected to output node 157.

A current mirror circuit is structured by p-channel MOS transistors 154 and 155, and another current mirror circuit is structured by transistors 155 and 156. Transistors 154 and 155 are manufactured in nearly the same size, and supply the same current amount I0 due to the current mirror effect.

A ratio of the gate width W and the gate length L, W/L, of transistor 151 is set to a relatively large value, and also the resistance value RO of resistance 152 is set to a relatively large value. Its operation will be described below.

Since transistors 154 and 155 constitute a current mirror circuit, the same current I0 is supplied to node A and node B. Current I0 through node B passes through transistor 151, and the current node A passes through transistor 153 to resistance 152. Transistor 153 provides a function of keeping current I0 passing through resistance 152 constant. More particularly, if current I0 passing through node C, i.e., resistance 152, is increased, a potential at node C is increased, the conductance of transistor 151 is increased, and the potential at node B decreases. Accordingly, the conductance of transistor 153 is decreased, and the current passing through node C is decreased. On the contrary, when the current passing through node C is decreased, the voltage at node C is decreased, the conductance of transistor 151 is decreased, and the potential at B is increased. Accordingly, the conductance of transistor 153 is increased, and a large current is supplied to node C.

Consequently, the current passing through transistor 151 and the current passing through resistance 152 become equal.

Resistance value R0 of resistance 152 is set to a relatively large value. Thus, the current I0 becomes small. In other words, the current passing through transistor 151 is also set to a very small current value. The gate width-gate length ratio W/L of transistor 151 is set to a relatively large value. In this case, a trans-conductance value given by the following relationship becomes relatively large, where $\mu n$ represents the electron mobility, Cox represents the gate capacitance, and Vds represents the drain-source voltage:

$$gm = \mu n \cdot (W/L)\ Cox \cdot Vds$$

In this case, transistor 151 operates in a saturation region ($Vd \geqq Vgs - Vthn$), and the current passing through transistor 151 is given by:

$$I = (K/2)\ (Vgs - Vthn)^2$$

where Vgs represents the gate-source voltage, Vthn represents the threshold voltage, and K represents a constant given by gm/Vds.

Since the current I0 is set to a sufficiently small value, the gate-source voltage Vgs of transistor 151 of approximately the threshold value VTH (=Vthn) is applied according to the above expression representing the current, and the voltage applied to resistance 152 becomes equal to the threshold voltage Vthn of MOS transistor 151. Thus, the current I0 passing through resistance 152 will be:

$$I0 = Vthn/R0.$$

according to $Vthn \sim I0 \cdot R0 = Vgs$

Since each of the resistance value R0 and the threshold voltage Vthn is a constant, a constant current will be generated.

Meanwhile, the current mirror circuit is structured by transistors 155 and 156. A predetermined current I1 is supplied from transistor 156 according to the gate width to gate length ratio of transistors 155 and 156. In other words, a constant current expressed by the following relationship is applied:

$$I1 = (W1/L1)/(W0/L0)$$

where W1/L1 represents the gate width to gate length ratio of transistor 156, and W0/L0 represents the gate width-gate length ratio of transistor 155.

Consequently, a constant Zener current based on the constant reference current I1 can be supplied as an operating current to constant voltage diode 132 shown in FIG. 11, and thus a predetermined reference voltage VREF can be obtained.

In the structure of constant current generating circuit 130 shown in FIG. 12, a phenomenon is observed, in which the potential at node A is increased due to the causes such as the deviation of power supply voltage Vcc, and then the transistor 154 becomes off. This is because the resistance value of resistance 152 is set to a sufficiently large value, if power supply voltage Vcc varies in a pulse manner, the potential at node A is increased. The potential of this node A is discharged through resistance 152 having a large resistance value R0, so that the potential VA at node A will not satisfy the relationship $$Vcc-VA>|Vthp|$$

Accordingly, transistor 154 turns into off state. This phenomenon in which the transistor 154 turns off triggers a series of operations, that is, the potential at node B is dropped (a discharge by transistor 151), transistor 153 becomes off, the potential at node C is dropped (a discharge by resistance 152), and transistor 151 turns off. As a result, the potential at node A becomes "H" (charged by diode connected transistor 155) and the potential at nodes B and C attains "L". Finally, all transistors 151–156 turn off. The circuit no longer operate as the constant current generating circuit.

By the way, in a semiconductor device such as a semiconductor memory device, a certain range (e.g., 0°–70° C.) is admitted for the operating temperature. In this case, characteristics of the operation of each element varies according to temperature.

FIG. 13 shows the temperature dependency of resistance (152) formed, for example, of polycrystalline silicon and the temperature dependency of the threshold voltage of MOS transistor. In FIG. 13, abscissa represents temperature T, while ordinate represents resistance value R and threshold voltage VTH. Straight line Ro shows the change of the resistance value in the resistance made, for example, of polycrystalline silicon, and straight line Vth shows the change of threshold voltage Vthn of n-channel MOS transistor. As shown in FIG. 13, resistance value Ro in resistance (152) has a positive temperature coefficient, and the resistance value increases according to the rise of the temperature. Meanwhile, threshold voltage Vthn of MOS transistor has a negative temperature coefficient decreases according to the rise of the temperature.

In the constant current generating circuit shown in FIG. 12, current I0 passing through resistance 152 is given by Vthn/R0. Thus, currents I0 and I1, which are generated by the constant current generating circuit, are decreased according to the temperature rise as shown in FIG. 14. In FIG. 14, abscissa represents temperature T and ordinate represents the amount of current I which is supplied by the constant current generating circuit. Straight lines shown in FIGS. 13 and 14 show the temperature dependency in an exaggerated manner.

Since reference currents I0 and I1 generated by the constant current generating circuit are decreased as the temperature rises, a correct reference voltage can not be generated in the reference voltage generating circuit shown in FIG. 11, so that internal power supply voltage Vdd generated from the internal voltage-down converter will change according to the temperature, and thus the internal circuit will not operate stably.

FIG. 15 shows the temperature dependency of the constant voltage diode. In FIG. 15, abscissa represents the Zener voltage and ordinate represents the temperature coefficient. Each curve represents the temperature dependency of Zener voltage Vz in each Zener current (operating current). The constant voltage diode have such characteristics that the voltage between its terminals will be constant when a certain amount of current is supplied under a reverse-biased condition. The sign of the temperature coefficient of the constant voltage diode changes with about 6 V being a border. More particularly, if Zener voltage Vz is above 6 V, the temperature coefficient is positive, while it is negative when the Zener voltage is below 6 V. This is because the Zener breakdown mechanism is dominant at lower Zener voltage, and the electron avalance mechanism is dominant at higher Zener voltage.

In the internal voltage-down converter of the semiconductor memory device, 3.3 V of the internal power supply voltage is usually generated, and the Zener voltage Vz equal to or less than this value is required. In this case, the Zener voltage applied by the constant voltage diode has a negative temperature coefficient: in other words the Zener voltage is decreased according to the rise of the temperature. By adding a forward-biased diode, it is possible to compensate for the temperature dependency: however, when the current I1, which is supplied to constant voltage diode 132 as an operating current from the constant current generating circuit, decreases according to the rise of the temperature, the temperature coefficient of Zener voltage Vz changes according to the change of the operating current. Therefore, it is not possible to compensate for the temperature dependency sufficiently even by the temperature-compensated constant voltage diode because its operating current changes, and accordingly as shown in FIG. 16, reference voltage VREF generated from the reference voltage generating circuit changes according to the rise of the temperature (FIG. 16 shows the case of the decrease of the reference voltage VREF), so that the internal power supply voltage of a constant level can not be generated stably.

In FIG. 16, abscissa represents temperature T, and ordinate represents reference voltage VREF generated from the internal reference voltage generating circuit.

SUMMARY OF THE INVENTION

An object of the present invention is to provide a circuit which can supply a constant current stably even when power supply voltage changes.

Another object of the present invention is to provide a circuit which can supply a constant current stably over a wide range of temperature.

Still another object of the present invention is to provide a constant current generating circuit utilized for generating a reference voltage, which can serve to generate a reference voltage stably even if the operating environment changes.

A constant current generating circuit according to the present invention includes a high resistive element which is normally turned on as a current supply source for a field effect transistor which keeps a voltage applied across the ends of a resistance element to its threshold voltage.

Since the high resistive element can continuously supply a very small current to the field effect transistor even if the power supply or the like changes, the voltage between a control electrode and the other conduction terminal of the field effect transistor can be kept at a constant value, and the voltage applied across the resistance element can be kept at a constant value. Thus, it is possible to generate the constant current stably even if the power supply or the like changes.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
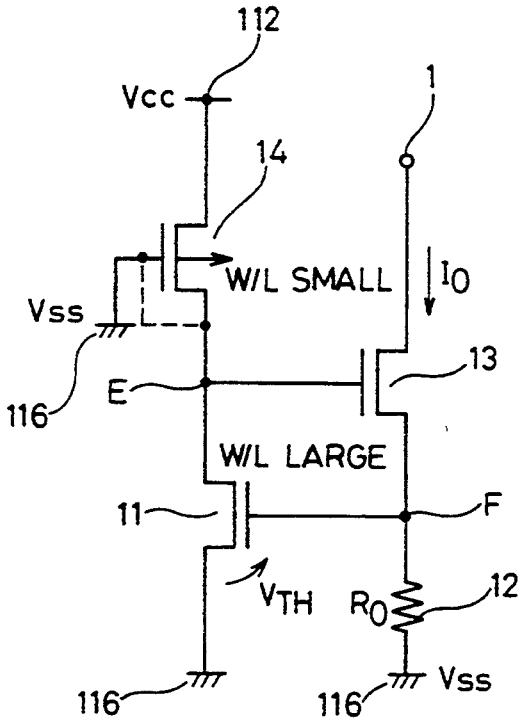
FIG. 1 shows a structure of a constant current generating circuit according to one embodiment of the present invention.

FIG. 1 shows a structure of a constant current generating circuit according to one embodiment of the present invention. In FIG. 1, the constant current generating circuit includes a p-channel MOS transistor 14 having a source connected to an external supply line 112, a drain connected to node E, and a gate connected to a ground line 116, a N-channel MOS transistor 11 having a drain connected to node E, a gate connected to node F and a source connected to ground line 116, a resistance 12 connected between node F and ground line 116, and a n-channel MOS transistor 13 having a drain connected to an output node 1, a gate connected to node E, and a source connected to node F.

The gate width W to gate length L ratio , W/L, of p-channel MOS transistor 14 is set to a sufficiently small value (e.g., one-several hundredth), while the gate width to gate length ratio, W/L, of n-channel MOS transistor 11 is set to a sufficiently large value (approximately several hundreds). p-channel MOS transistor 14 having a gate connected to ground line 116 is normally turned on, and has a small conductance, and supplies a very small current (approximately a few μA). An operation thereof will be described below.

Transistor 14 is normally turned on, because its gate is at the potential level of ground potential Vss which is sufficiently lower than power supply voltage Vcc. A very small current is normally supplied to transistor 11 via transistor 14. Transistor 11 operates in a saturation region, and has a sufficiently large conductance because of a significantly large gate width to gate length ratio, W/L. Thus, according to a relationship of a drain current in the saturation operation:

$$I=(W/L)\mu n\cdot Cox(Vgs-Vthn)^2$$

the gate-source voltage of transistor 11 becomes nearly equal to threshold voltage VTH (=Vthn). In other words, the potential level at node F is equal to threshold voltage VTH of transistor 11. Accordingly, a constant current expressed as:

$$I0=Vth/R0$$

is passed through resistance 12, where R0 represents the resistance value of resistance 12.

Transistor 13 operates in a saturation region. Because W/L of transistor 14 is sufficiently small and W/L of transistor 11 is sufficiently large, the voltage at node E is sufficiently low (it should be noted that a coefficient W/L can be related to a conductance of MOS transistor). Thus, transistor 13 satisfies a condition of operation in the saturation region defined by:

$$Vd \geqq Vg-Vthn$$

Transistor 13 supplies a constant current I0 regardless of the voltage at output node 1 (drain voltage). From another point of view, transistor 13 can be considered to supply a constant current by the feedback function. More particularly, when current I0 at output node 1 increases, the potential at node F increases. Accordingly, the conductance of transistor 11 increases, the potential at node E decreases, the conductance of transistor 13 decreases, and then the amount of the current supplied to node F decreases. On the contrary, when current I0 decreases, the potential at node F decreases, the conductance of transistor 11 decreases, and the potential at node E increases. Accordingly, the conductance of transistor 13 increases so as to increase the amount of the current supplied to node F. Through this operation, the current passing through resistance 12 can be kept at a constant value. By this function of transistor 13, a constant current I0 can be constantly supplied stably in spite of the changes of potential and current at output node 1.

Figure 2:
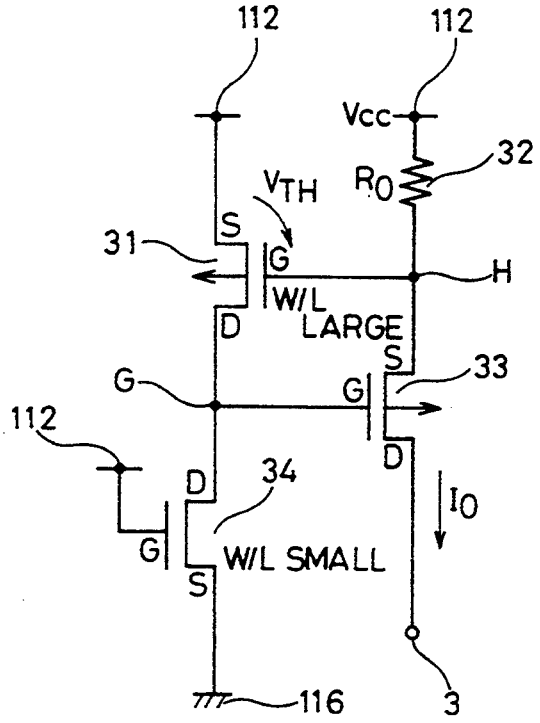
FIG. 2 shows a structure of a constant current generating circuit according to another embodiment of the present invention.

FIG. 2 shows a structure of a constant current generating circuit according to another embodiment of the present invention. In FIG. 2, the constant current generating circuit includes a p-channel MOS transistor 31 having a source connected to external supply line 112, a drain connected to node G, and a gate connected to node H, a n-channel MOS transistor 34 having a drain connected to node G, a source connected to ground line 116 and a gate connected to external supply line 112, a p-channel MOS transistor 33 having a gate connected to node G, a source connected to node H, and a drain connected to output node 3, and a resistance 32 connected between node H and external supply line 112.

The gate width to gate length ratio, W/L, of transistor 31 is set to a sufficiently large value (approximately several hundreds), while the gate width to gate length ratio, W/L, of transistor 34 is set to a sufficiently small value (approximately one-several hundredth). Transistor 34 having its gate connected to external supply line 112 is normally turned on, and normally supplies a very small current (approximately a few μA).

The constant current generating circuit shown in FIG. 2 can be implemented by inverting the polarity of MOS transistor as well as the polarity of the power supply voltage in the constant current generating circuit shown in FIG. 1. Thus, its operation is as same as that of the reference current generating circuit shown in FIG. 1. More particularly, in this case, a constant current expressed as:

$$I0 = VTH(= -Vthp)/R0$$

is applied to resistance 32, where Vthp represents the threshold voltage of MOS transistor 31 and is a negative value.

Transistor 33 is a feedback transistor just like transistor 13 shown in FIG. 1 provided for absorbing the variation of the potential at output node 3, and supplies a constant current I0 at output node 3 regardless of the potential at output node 3 by operating in the saturation region. As for the potential at a gate (node G) of transistor 33, since the gate width to gate length ratio, W/L, of transistor 34 is set to a sufficiently small value and the gate width to gate length ratio, W/L, of transistor 31 is set to a sufficiently large value, the potential level at node G is a sufficiently high voltage level, so that transistor 33 is ensured to operate in the saturation region.

Figure 3:
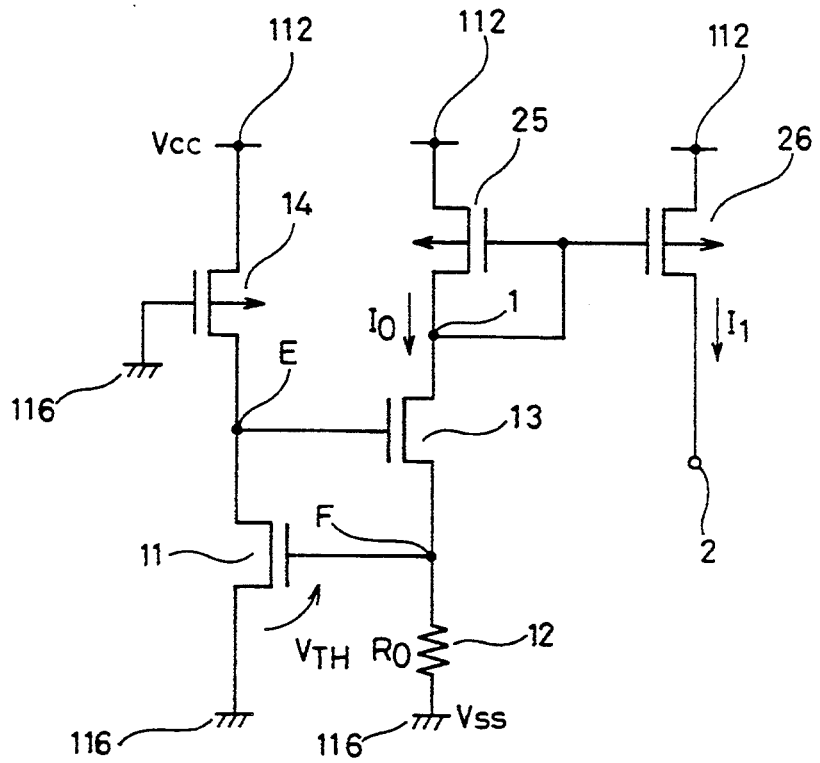
FIG. 3 shows a structure of a constant current generating circuit according to a further embodiment of the present invention.

FIG. 3 shows a structure of a constant current generating circuit according to still another embodiment of the present invention. In the constant current generating circuit shown in FIG. 3, p-channel MOS transistors 25 and 26 constituting the current mirror circuit are additionally provided to output node in the constant current generating circuit shown in FIG. 1. Like reference numerals are given to the similar components corresponding to those in the constant current generating circuit shown in FIG. 1, and thus the description thereof is not given. In FIG. 3, p-channel MOS transistor 25 has a gate and drain connected to output node 1, and a source connected to external supply line 112. MOS transistor 26 has a source connected to external supply line 112, a gate connected to node 1, and a drain connected to output node 2. The operation in the circuit portion by transistors 11–14 and resistance 12 is same as that of the constant current generating circuit shown in FIG. 1. Transistors 25 and 26 supply the current given by:

$$I1 = I0 \cdot (W26/L26)/(W25/L25)$$

to output node 2 by the current mirror operation, where W25 and L25 represent the gate width and the gate length of transistor 25, respectively, and W26 and L26 represent the gate width and the gate length of transistor 26, respectively.

In the constant current generating circuit shown in FIG. 3, even if power supply voltage Vcc changes and the potential at node 1 increases, transistor 13 supplies a constant current I0 to resistance 12 regardless of the increase of the potential, and thus the rise of the potential at node 1 can be absorbed quickly through transistor 13 and transistor 26 is not turned off. Therefore, stable and constant current I1 can be supplied.

Figure 4:
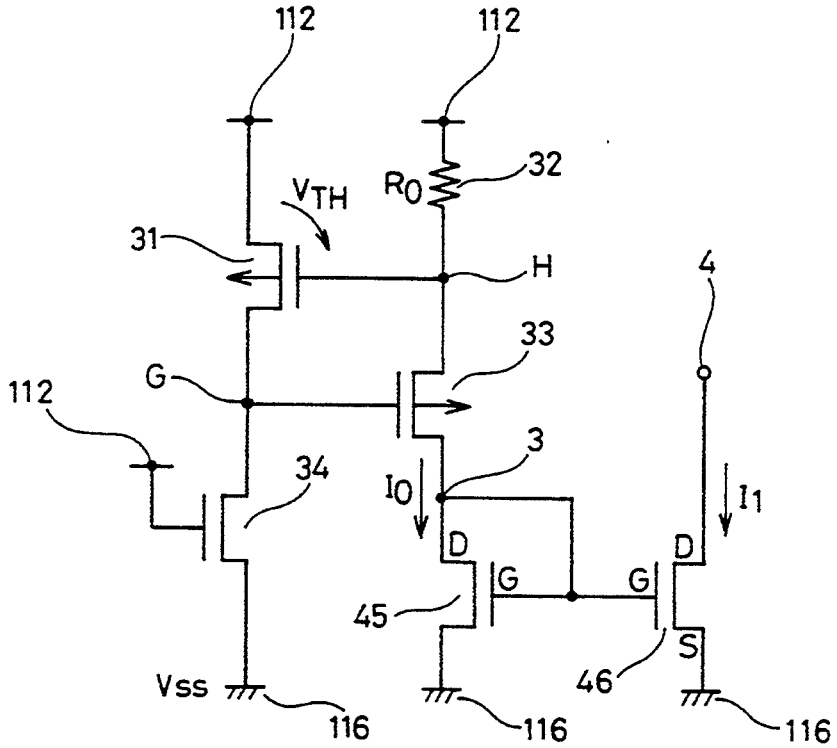
FIG. 4 shows a structure of a constant current generating circuit according to still another embodiment of the present invention.

FIG. 4 shows a structure of a constant current generating circuit according to a further embodiment of the present invention. In the constant current generating circuit shown in FIG. 4, n-channel MOS transistors 45 and 46 constituting the current mirror circuit are added to output node 3 of the constant current generating circuit shown in FIG. 2. Transistor 45 has a gate and drain connected to node 3, and a source connected to ground line 116. Transistor 46 has a gate connected to node 3, a source connected to ground line 116, and a drain connected to output node 4. The constant current generating circuit shown in FIG. 4 can be implemented by inverting the polarity of MOS transistors in the constant current generating circuit shown in FIG. 3, so that an operation thereof is similar to that of the constant current generating circuit shown in FIG. 3. Also in this case, reference current I1 which is determined by the gate width to gate length ratio of transistor 46 and the gate width to gate length ratio of transistor 45 can be obtained.

The constant current generating circuits shown in FIGS. 1 through 4 are implemented by connecting the gate of MOS transistor serving as a high resistance element and having a sufficient small coefficient W/L to power supply voltage Vcc or ground potential Vss. The gate and the drain of MOS transistor may be connected together so as to function as a resistance, rather than connecting the gate of MOS transistor to power supply voltage Vcc or ground potential Vss as shown by dotted line in FIG. 1. In this case, the current limitation effect required to supply a very small current can be further improved. Since a voltage drop across the resistance-connected MOS transistor is approximately equal to its threshold voltage VTH, and the source-gate voltage of the transistor for applying a constant voltage to the resistance is equal to threshold voltage VTH and requires a drain voltage of at least threshold voltage VTH thereof. The value of external power supply voltage Vcc is required to be at least 3·VTH. For example, in the structure of the constant current generating circuit shown in FIG. 1, when the gate and the drain of transistor 14 are resistance-connected as shown by the dotted line, the voltage drop across transistor 14 equals to threshold voltage VTH, and the gate-source voltage of transistor 11 equals to threshold voltage VTH. In order to operate transistor 13 in the saturation region, the potential difference between node E and node F is required to be at least the threshold voltage, that is, the potential level of node E has to be at least 2·VTH. Thus, power supply voltage Vcc is required to be at least 3·VTH.

Also, a resistance element such as a diffusion resistance or a polycrystalline silicon resistance may be utilized instead of MOS transistors (14, 34) as a high resistive element for supplying a very small current so long as resistance value thereof is set appropriately to supply a very small current.

The constant current generating circuits shown in FIGS. 1 through 4 are shown to be employed by the internal voltage-down converter which internally down-converts the external power supply voltage to generate the internal power supply voltage. These constant current generating circuits, however, can be applied to the circuit portion, which requires a constant current, in any semiconductor devices and semiconductor circuits.

Figure 5:
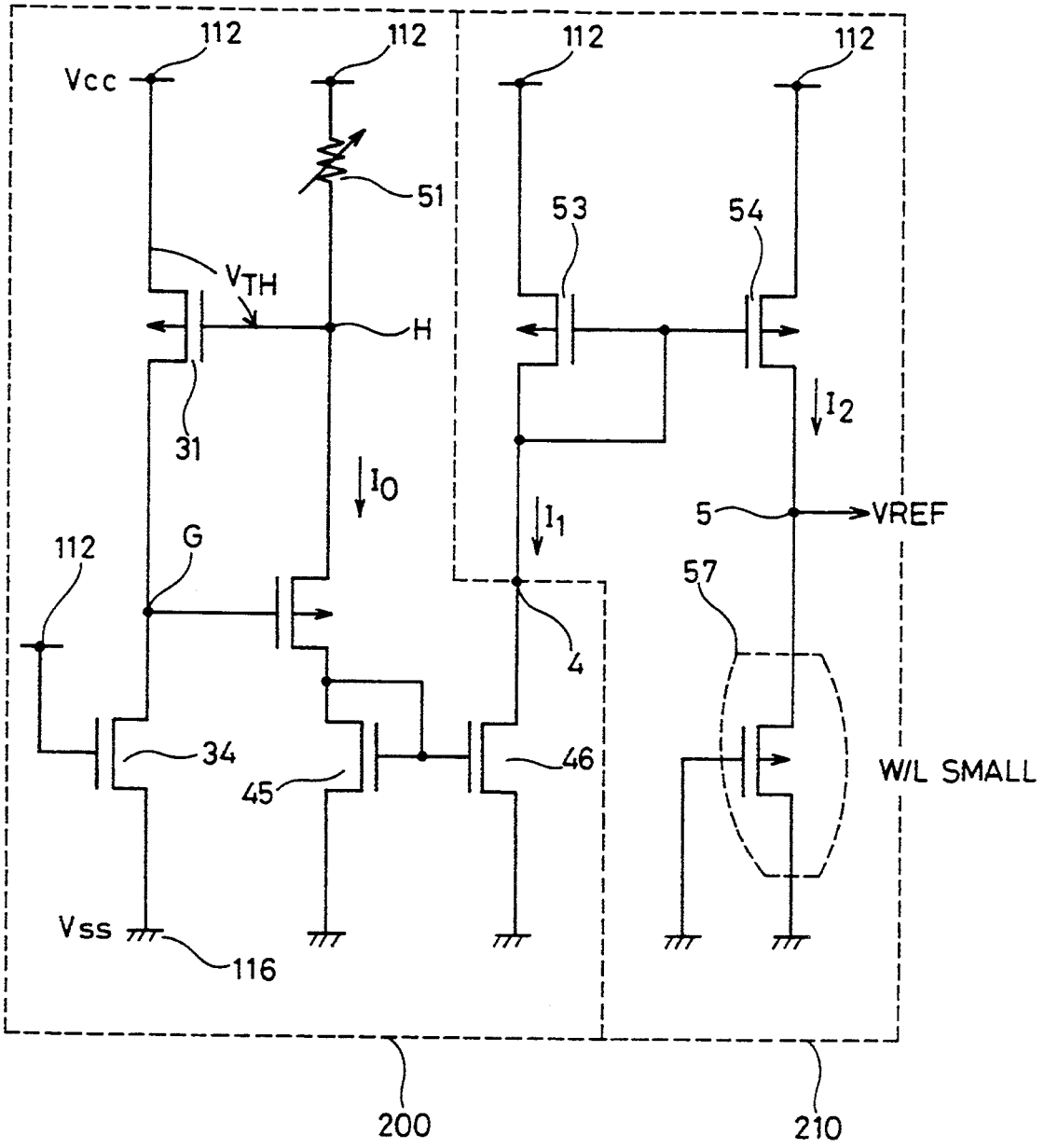
FIG. 5 shows a structure of a reference voltage generating circuit utilizing the constant current generating circuit according to the present invention.

FIG. 5 shows a structure of a reference voltage generating circuit utilizing the constant current generating circuit according to the present invention. This reference voltage generating circuit may be employed in the internal voltage-down converter, and it may be used where a reference voltage is required in other circuit portions.

In FIG. 5, the reference voltage generating circuitry includes a circuit portion 200 which generates a constant current, and a circuit portion 210 which generates a predetermined reference voltage VREF according to the constant current.

Reference current generating circuit portion 200 has a similar structure to the reference current generating circuit shown in FIG. 4 except the structure of resistance element 51. The resistance value of resistance element 51 is trimmable. The remaining is similar to those in the reference current generating circuit shown in FIG. 4, and like reference numerals are given to the corresponding parts.

Circuit portion 210 generating a reference voltage includes p-channel MOS transistors 53 and 54 which are connected to an output node 4 of reference current generating circuit 200 so as to structure a current mirror circuit, and p-channel MOS transistor 57 which functions as a resistance element to transistor 54 for generating a constant reference voltage VREF at output node 5. The resistance value of the transistor 57 is trimmable. The gate width to gate length ratio, W/L, of MOS transistor 57 is made sufficiently small. Since MOS transistor 57 functions as a resistance, reference voltage REF is generated according to a product of a constant current I2 supplied from transistor 54 and the resistance value of the transistor 57.

Operation at each circuit portion is similar to that in the constant current generating circuit described above, and its operation will not be described repeatedly in detail below. Trimmable resistance element 51 and MOS transistor 57 having a trimmable resistance value will be described below.

Figure 6:
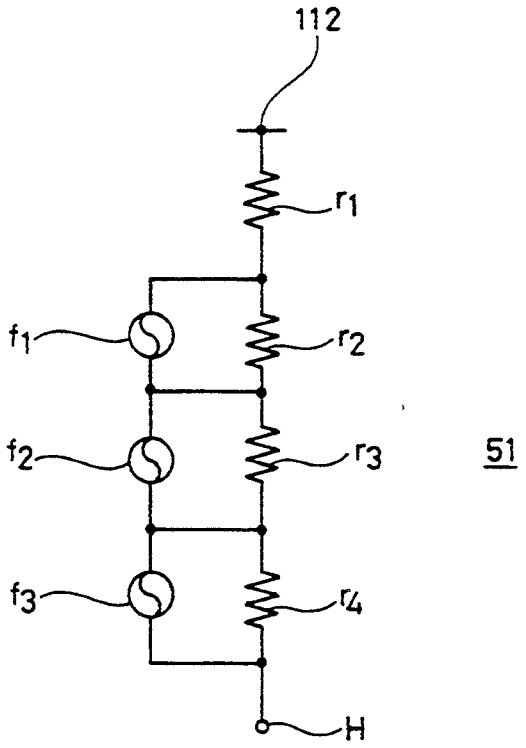
FIG. 6 shows a specific structure of a trimmable resistance element shown in FIG. 5.

FIG. 6 shows a structure of a specific example of trimmable resistance element 51 shown in FIG. 5. In FIG. 6, trimmable resistance element 51 includes resistance elements r1–r4 serially connected between supply line 112 and node H, and fusible link elements f1–f3 connected parallel to resistances r2–r4. Link elements f1–f3 are formed by, for example, a fuse element which can be melted out (or blown off) by laser. Resistances r1–r4 are each structured by, for example, polycrystalline silicon. Trimming of this trimmable resistance element 51 will be described below.

Various tests are carried out after manufacturing a semiconductor device (e.g., a semiconductor memory device). The inspection to determine whether or not a predetermined reference voltage VREF is generated is carried out at the same time. During the inspection, link elements f1–f3 are connected or conductive. Since resistances r2–r4 are short-circuited by link elements f1–f3, the resistance value of resistance element 51 is given by resistance r1.

During the test, a link element is melted out if reference voltage VREF is higher than a predetermined reference level. In resistance element 51, its resistance value increases as the number of resistances connected between supply line 112 and output node H increases. Accordingly, the value of current I0 passing through node H (see FIG. 5) is reduced (according to a relationship I0=VTH/R0).

As the current I0 decreases, the value of the current I2 supplied from transistor 54 in a structure shown in FIG. 5 also decreases, and thus the potential level of reference voltage VREF decreases. Consequently, reference voltage VREF, which is higher than a predetermined voltage level, is modified to a desired value. Trimming of MOS transistor 57 functioning as a resistance element will be described.

Figure 7:
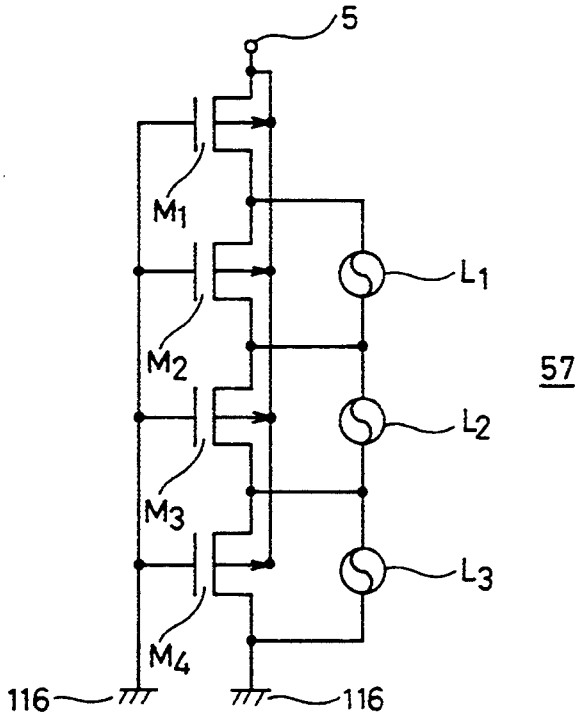
FIG. 7 shows a specific structure of a trimmable MOS transistor shown in FIG. 5.

FIG. 7 shows a structure of trimmable MOS transistor 57. In FIG. 7, trimmable MOS transistor 57 includes p-channel MOS transistors M1–M4 serially connected between output node 5 and ground line 116 and fusible link elements L1–L3 respectively connected parallel to MOS transistors M2–M4. MOS transistors M1–M4 have each gate connected to ground line 116. The gate width to gate length ratios, W/L, of MOS transistors M1–M4 are set to sufficiently small values, and MOS transistors M1–M4 function as resistance elements. Substrates (or well region) of MOS transistors M1–M4 are commonly connected to output node 5. The operation of MOS transistors M1–M4 can be stabilized by biasing the substrate thereof with reference voltage VREF.

At completion of manufacturing, link elements L1–L3 are connected or conductive. In this state, only a resistance component provided by MOS transistor M1 is provided between output node 5 and ground line 116. The gate width to gate length, W/L, of MOS transistors M1–M4 are set to small values. According to a constant current I2 from transistor 54, reference voltage VREF is generated based on the existing resistance component.

During the test, if reference voltage VREF is determined to be lower than a predetermined potential level, a suitable one or more of link elements L1–L3 is melted out by, for example, laser-blow. Thus, resistance component (by MOS transistor) connected between output node 5 and ground line 116 increases, and the potential level of reference voltage VREF increases, so that the reference voltage, which was lower than a predetermined level, can be set to a predetermined level. Link elements f1–f3 and L1–L3 respectively shown in FIGS. 6 and 7 melted out in the same process as laser blow process carried out during the repairing of defective word lines and bit lines of a semiconductor memory device. The advantages of employing both trimmable resistance element 51 and trimmable MOS transistor 57 will be described.

Figure 8:
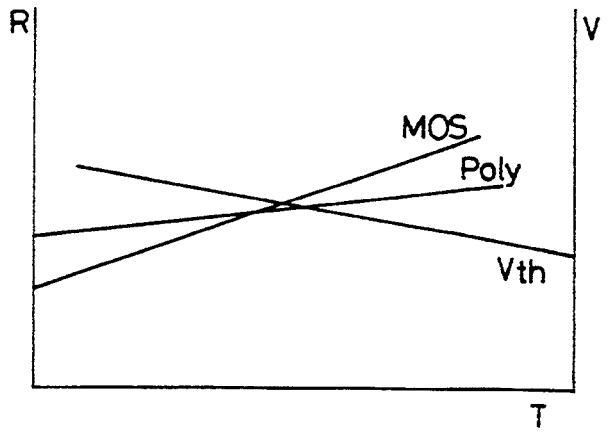
FIG. 8 shows the temperature dependency of MOS transistor, the resistance value of the polycrystalline silicon resistance, and the threshold voltage of MOS transistor.

FIG. 8 shows the temperature dependency of the resistance values of the polycrystalline silicon resistance and MOS transistor as well as the temperature dependency of the threshold voltage of MOS transistor. Abscissa represents temperature, and ordinate represents the resistance value and the threshold voltage. Straight line MOS shows the temperature dependency of the resistance value of MOS transistor, and straight line Poly shows the temperature dependency of the resistance value of polycrystalline silicon resistance. Straight line Vth shows the temperature dependency of the threshold voltage of MOS transistor.

As shown in FIG. 8, both the polycrystalline silicon resistance and MOS transistor resistance have a positive temperature coefficient, so that the resistance values therein increase according to the rise of the temperature. The temperature coefficient of the resistance component of MOS transistor is greater than that of polycrystalline silicon resistance. The threshold voltage VTH of MOS transistor has a negative temperature coefficient, so that the threshold voltage decreases according to the rise of the temperature.

In a structure shown in FIG. 5, when the temperature increases, the resistance value of trimming resistance element 51 rises, while threshold voltage VTH drops. Since the current I0 passing through node H is represented as VTH/R0, the value of the current I0 decreases. Here, the resistance components of MOS transistor 57 increases according to the temperature. A temperature-dependent increase of the resistance component of MOS transistor 57 is greater than that of the resistance value of trimmable resistance element 51. Even if reference current I0 drops, reference voltage VREF can be set to an almost constant value regardless of the temperature, because resistance component of MOS transistor increases.

The operating speed of MOS transistor which is a component of an internal circuit generally slows down a little according to the rise of the temperature. The decreased operating speed is compensated for by increasing reference voltage VREF a little. More particularly, a contribution of MOS transistor 57 to the increase of reference voltage VREF caused by the rise of the temperature is made a little greater than the contribution of the decrease of the constant current over reference voltage VREF caused by the increase of the resistance value of trimming resistance 51 as well as the decrease of threshold voltage VTH. This is set within the range where the internal power supply voltage is increased by about 0.1–0.2 V according to the rise of the temperature.

Figure 9:
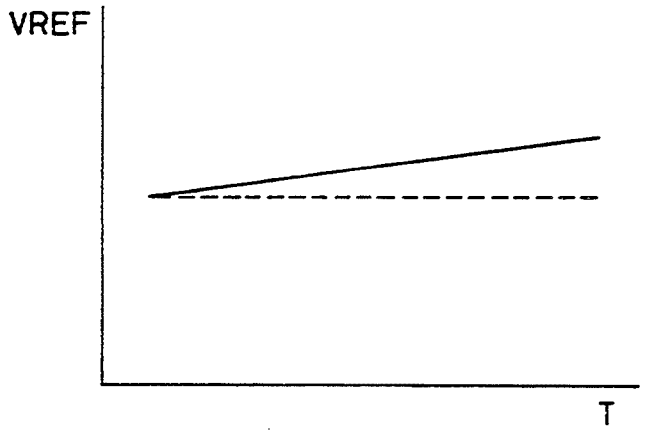
FIG. 9 shows the temperature dependency of the reference voltage generated from the reference voltage generating circuit shown in FIG. 5.
Figure 10:
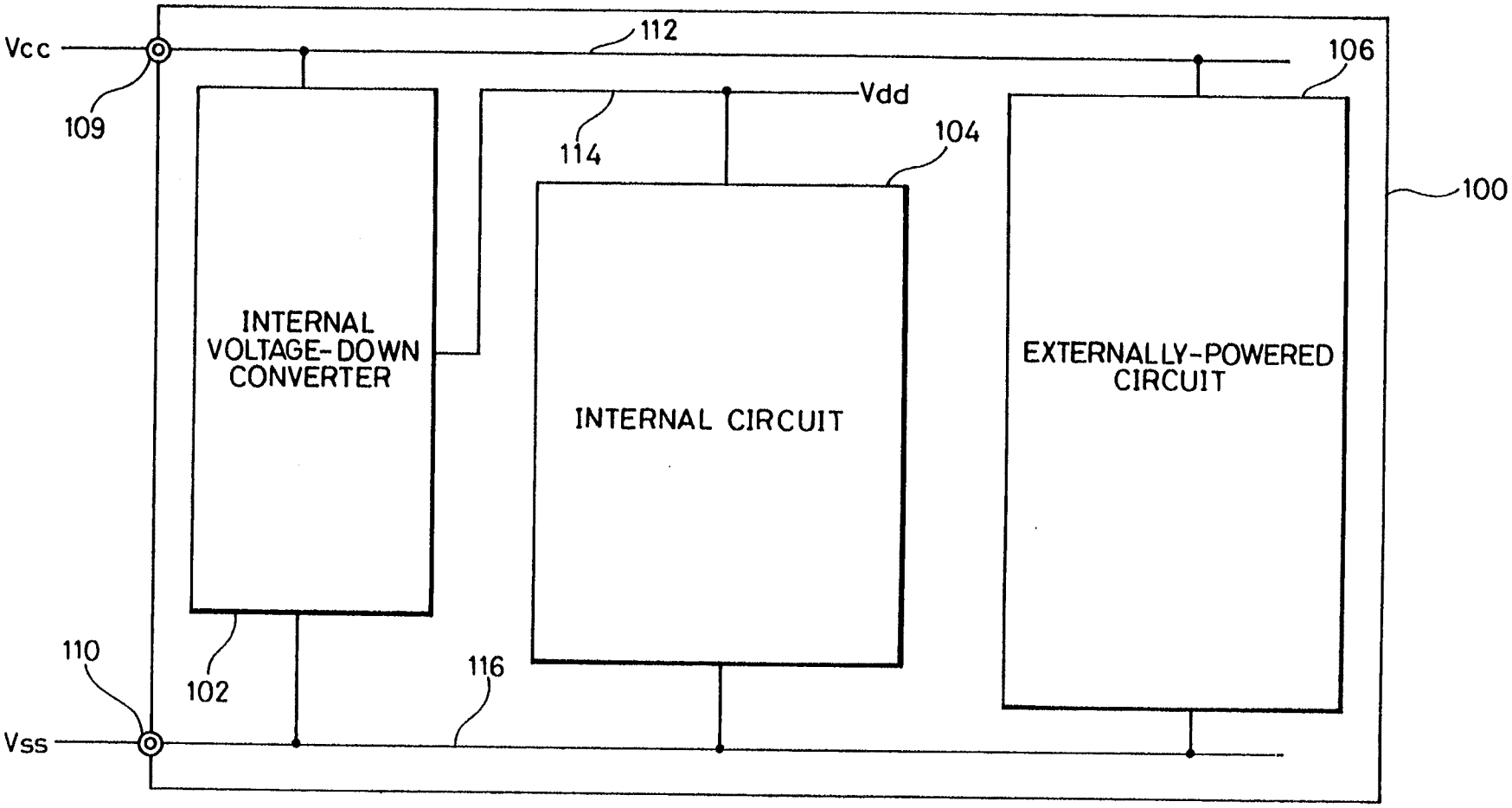
FIG.10 PRIOR ART
FIG. 10 shows an overall structure of a general semiconductor memory device.
Figure 11:
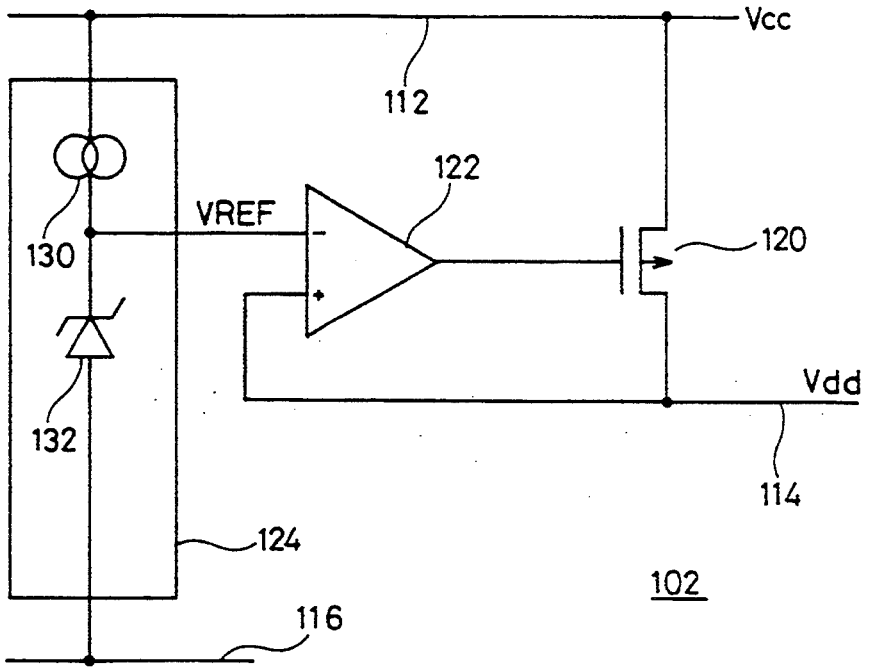
FIG.11 PRIOR ART
FIG. 11 shows a specific structure of an internal voltage-down converter shown in FIG. 10.
Figure 12:
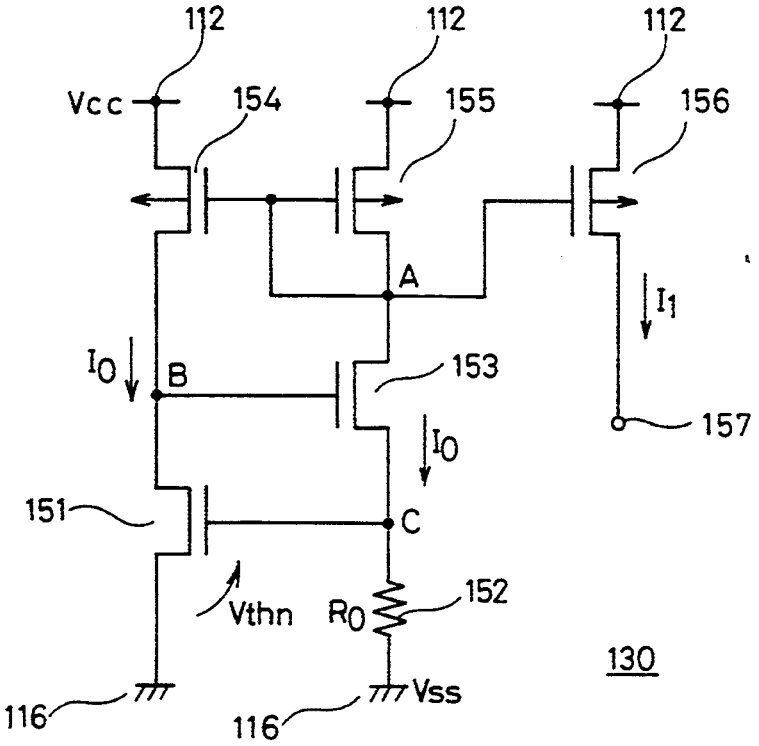
FIG.12 PRIOR ART
FIG. 12 shows a specific structure of a constant current source shown in FIG. 11.
Figure 13:
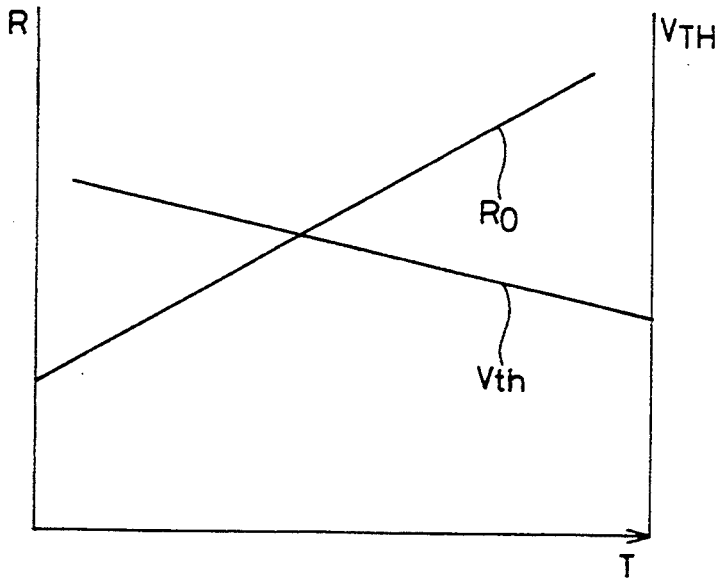
FIG.13 PRIOR ART
FIG. 13 shows the temperature dependency of the resistance value of the polycrystalline silicon resistance and the threshold voltage of MOS transistor.
Figure 14:
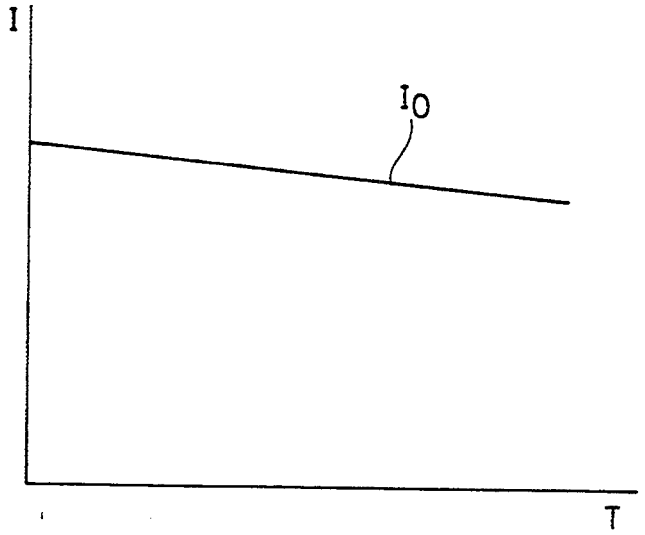
FIG.14 PRIOR ART
FIG. 14 shows the temperature dependency of an output current in a conventional constant current generating circuit.
Figure 15:
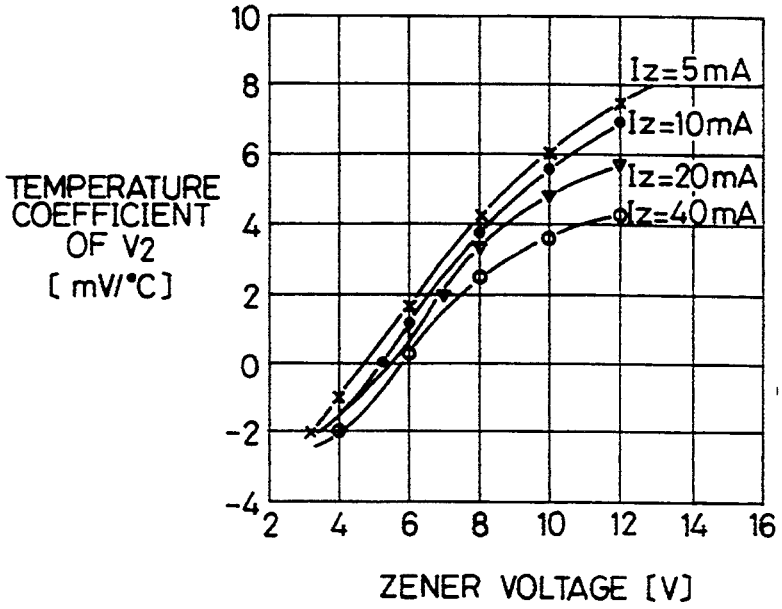
FIG.15 PRIOR ART
FIG. 15 shows the temperature dependency of a general constant voltage diode.
Figure 16:
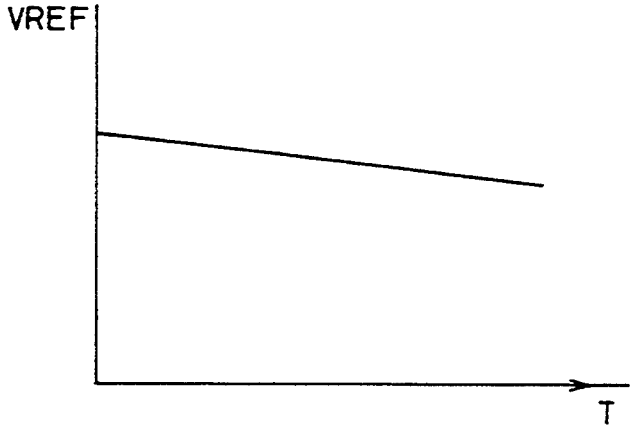
FIG.16 PRIOR ART
FIG. 16 shows the temperature dependency of a reference voltage in a conventional reference voltage generating circuit.

As a result, as shown in FIG. 9, reference voltage VREF can be increased a little (about 0.1–0.2 V) according to the rise of the temperature, so that the internal circuit can be operated reliably without impairing the operating characteristic of the internal circuit even when the temperature rises. In this case, if the polycrystalline silicon resistance is employed instead of MOS transistor for generating the reference voltage, such a compensation of the temperature dependency can not be carried out. As shown in FIG. 5, by employing both the polycrystalline silicon resistance and resistance component of MOS transistor together, temperature-compensated reference voltage VREF can be generated more reliably.

In the embodiment described above, the reference voltage generating circuit is utilized to generate the internally down-converted power supply voltage. The reference voltage, however, may be utilized in the other circuit portion, and also it may be used in the circuit portion where a constant reference voltage is required. The constant current and the reference voltage may be generated from the internal operating power supply voltage rather than from the external power supply voltage.

As described above, in the structure according to the present invention, a predetermined voltage (the threshold voltage of MOS transistor) is applied across the resistance element by normally supplying a very small current to the MOS transistor, so that a constant current can be supplied reliably while not being affected by the change of the power supply voltage. Also, because MOS transistor operating in the saturation region is provided between the resistance element and the output node, a constant current can be supplied stably regardless of the change of the potential at the output node.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A constant current generating circuit, comprising:

a first resistive means having a first end connected to a first power supply and a second end, for supplying a small current flow;

a first insulated gate type field effect transistor having a first conduction terminal connected to said second end of said first resistive means, a second conduction terminal connected to a second power supply, and a control terminal, capable of supplying a large current flow;

a second resistive element having a first end connected to said control terminal of said first insulated gate type field effect transistor and a second end connected to said second power supply; and a second insulated gate-type field effect transistor having a control electrode connected to said first conduction terminal of said first insulated gate type field effect transistor, a first conduction terminal connected to said first end of said second resistive element, and a second conduction terminal connected to an output node.

2. The circuit according to claim 1, wherein said first resistive element comprises an insulated gate type transistor having a control gate connected to said second power supply.

3. The circuit according to claim 1, wherein said first resistive element comprises an insulated gate type transistor having a first conduction terminal connected to said first power supply, and a control gate and a second conduction terminal connected together.

4. The circuit according to claim 1, wherein said first resistive element has a smaller conductance than said first insulated gate type field effect transistor has.

5. The circuit according to claim 1, wherein said first resistive element includes an insulated gate type field effect transistor having a smaller gate width to gate length ratio than that of said first insulated gate type field effect transistor.

6. The circuit according to claim 1, further comprising a current mirror component coupled to said output node for supplying to another output node a current flow corresponding to a current flow amount flowing through said second insulated gate type field effect transistor.

7. The circuit according to claim 6, further comprising a third resistive element connected between said another output node and said second power supply.

8. The circuit according to claim 7, wherein said second resistive element comprises a polysilicon resistance having a trimmable resistance value.

9. The circuit according to claim 7, wherein said second resistive element includes a plurality of polysilicon resistors connected in series between said second power supply and said control terminal of said first transistor, and a plurality of fusible link elements provided corresponding to said plurality of polysilicon resistors and in parallel with corresponding polysilicon resistors.

10. The circuit according to claim 7, wherein said third resistive element comprises a resistor-connected insulated gate type field effect transistor having a trimmable resistance value.

11. The circuit according to claim 7, wherein said third resistive element includes a plurality of insulated gate type field effect transistors connected in series between said second power supply and said additional output node, each of said plurality of insulated gate type having a control gate connected to said second power supply, and a plurality of fusible link element provided corresponding to said plurality of insulated gate type field effect transistors and in parallel with corresponding insulated gate type field effect transistors.

12. A circuit for generating a reference current flow at an output node, comprising:

a first resistance element having a first end connected to receive a first power supply voltage, for constantly supplying a small current flow therethrough in operation;

a second resistance element having an end connected to receive a second power supply voltage;

a transistor element having a threshold voltage and responsive to said small current flow of said first resistance element for applying a voltage of said threshold voltage across said second resistance element; and an element provided between said output node and said second resistance element, for absorbing a potential change at said output node to cause a constant current flow flowing through said second resistance element, in response to a potential difference between another end of said first resistance element and said output node.

* * * * *